US006199403B1

(12) United States Patent
Cole et al.

(10) Patent No.: US 6,199,403 B1
(45) Date of Patent: Mar. 13, 2001

(54) PROCESS FOR SEPARATING A MULTI-COMPONENT PRESSURIZIED FEED STREAM USING DISTILLATION

(75) Inventors: Eric T. Cole, Kingwood; Brandon T. Stone, Houston, both of TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 09/422,456

(22) Filed: Oct. 21, 1999

Related U.S. Application Data

(60) Provisional application No. 60/105,235, filed on Oct. 22, 1998.

(30) Foreign Application Priority Data

Feb. 9, 1998 (DE) ..... 198 04 801

(51) Int. Cl.[7] ..... F25J 1/00
(52) U.S. Cl. ..... 62/613; 62/619; 62/639
(58) Field of Search ..... 62/613, 619, 639

(56) References Cited

U.S. PATENT DOCUMENTS 3,298,805 1/1967 Secord et al. ..... 48/190
3,331,213 * 7/1967 Harmens ..... 62/639

(List continued on next page.)

OTHER PUBLICATIONS

Bennett, C.P. Marine Transportation of LNG at Intermediate Ttemperature, *CME* (Mar. 1979), pp. 63–64.

Faridany, E. K., Secord, H.C, O'Brien, J. V., Pritchard, J. F., and Banister, M. The Ocean PHoenix Pressure–LNG System, GASTECH 76 (1976), New York, pp. 267–280.

Faridany, E. K., Ffooks R. C., and Meikle, R. B. A Pressure LNG System, European Offshore Petrolem Conference & Exhibition (Oct. 21–24, 1980), vol. EUR 171, pp. 245–254.

Broeker, R. J. CNG and MLG—New Natural Gas Transportation Processes, *American Gas Journal* (Jul. 1969) pp. 138–140.

Fluggen, Prof. E. and Backhaus, Dr. I. H. Pressurised LNG—and the Utilisation of Small Gas Fields, GASTECH78, LNG/LPG Conference (Nov. 7, 1978), Monte Carlo pp. 195–204.

Broeker, R. J. A New Process for the Transportation of Natural Gas, Proceedings of the First International Conference on LNG (1968), Chicago, Illinois, Session No. 5, Paper 30, pp. 1–11.

Ladkany, S. G. Composite Aluminum–Fiberglass Epoxy Pressure Vessels for Transportation of LNG at Intermediate Temperature, published in *Advances in Cryogenic Engineering, Materials,* vol. 28, (Proceedings of the 4th International Cryogenic Materials Conference), San Diego, CA, USA, Aug. 10–14, 1981, pp. 905–913.

*Primary Examiner*—Ronald Capossela
(74) *Attorney, Agent, or Firm*—Gary D. Lawson

(57) ABSTRACT

A process is disclosed to remove a high-volatility component, such as nitrogen, from a feed stream rich in methane to produce a product substantially free of the high-volatility component. The feed stream is expanded and fed to a phase separator which produces a vapor stream and a liquid stream. The vapor stream is enriched in the volatile component. The liquid stream, which is lean in the volatile component and rich in methane, is pumped to a higher pressure and heated to produce a pressurized liquefied product stream having a pressure sufficient for the product stream to be at or below its bubble point and having a temperature above about −112° C. (−170° F.).

12 Claims, 2 Drawing Sheets

U.S. PATENT DOCUMENTS

| | | | | |
|---|---|---|---|---|
| 3,596,472 | | 8/1971 | Streich | 62/28 |
| 3,797,261 | | 3/1974 | Juncker et al. | 62/40 |
| 3,830,180 | | 8/1974 | Bolton | 114/74 A |
| 3,874,184 | | 4/1975 | Harper et al. | 62/28 |
| 4,017,283 | | 4/1977 | Witt. | 62/40 |
| 4,172,711 | | 10/1979 | Bailey | 62/21 |
| 4,225,329 | | 9/1980 | Bailey et al. | 62/24 |
| 4,359,871 | * | 11/1982 | Strass | 62/619 |
| 4,411,677 | | 10/1983 | Pervier et al. | 62/25 |
| 4,451,275 | | 5/1984 | Vines et al. | 62/28 |
| 4,504,295 | | 3/1985 | Davis et al. | 62/30 |
| 4,592,767 | | 6/1986 | Pahade et al. | 62/31 |
| 4,617,039 | | 10/1986 | Buck | 62/26 |
| 4,645,522 | * | 2/1987 | Bobrotwir | 62/619 |
| 4,662,919 | | 5/1987 | Davis | 62/25 |
| 4,664,686 | | 5/1987 | Pahade et al. | 62/24 |
| 4,675,037 | | 6/1987 | Newton | 62/28 |
| 4,732,598 | | 3/1988 | Rowles et al. | 62/28 |
| 4,805,413 | | 2/1989 | Mitchell et al. | 62/24 |
| 4,851,020 | | 7/1989 | Montgomery, IV | 62/64 |
| 4,854,955 | | 8/1989 | Campbell et al. | 62/24 |
| 4,970,867 | | 11/1990 | Herron et al. | 62/11 |
| 5,036,671 | | 8/1991 | Nelson et al. | 62/23 |
| 5,051,120 | | 9/1991 | Pahade et al. | 62/24 |
| 5,120,338 | | 6/1992 | Potts et al. | 62/12 |
| 5,257,505 | | 11/1993 | Butts | 62/24 |
| 5,375,422 | | 12/1994 | Butts | 62/24 |
| 5,414,190 | | 5/1995 | Förg et al. | 585/802 |
| 5,421,165 | | 6/1995 | Paradowski et al. | 62/24 |
| 5,505,049 | | 4/1996 | Coyle et al. | 62/11 |
| 5,537,827 | | 7/1996 | Low et al. | 62/613 |
| 5,611,216 | | 3/1997 | Low et al. | 62/612 |
| 5,802,871 | | 9/1998 | Howard et al. | 62/627 |
| 5,878,814 | | 3/1999 | Breivik et al. | 166/267 |
| 5,893,274 | | 4/1999 | Nagelvoort et al. | 62/613 |
| 5,950,453 | | 9/1999 | Bowen et al. | 62/612 |
| 5,956,971 | | 9/1999 | Cole et al. | 62/623 |

* cited by examiner

PROCESS FOR SEPARATING A MULTI-COMPONENT PRESSURIZIED FEED STREAM USING DISTILLATION

This application claims the benefit of U.S. Provisional Application No. 60/105,235, filed Oct. 22, 1998.

FIELD OF THE INVENTION

This invention relates generally to a process for separating a multi-component feed stream using fractionation and producing a pressurized, refrigerated liquid product. More specifically, the invention relates to a process for separating a multi-component stream containing methane and at least one high volatility component having a relative volatility greater than that of methane and producing pressurized liquefied natural gas.

BACKGROUND OF THE INVENTION

Because of its clean burning qualities and convenience, natural gas has become widely used in recent years. Many sources of natural gas are located in remote areas, great distances from any commercial markets for the gas. Sometimes a pipeline is available for transporting produced natural gas to a commercial market. When pipeline transportation is not feasible, produced natural gas is often processed into liquefied natural gas (which is called "LNG") for transport to market.

Natural gas often contains diluent gases such as nitrogen and helium. The presence of these gases reduces the heating value of the natural gas. Also, certain of these gases may have independent commercial uses if they can be separated from the natural gas. Consequently, the separation of diluent gases from natural gas may have twofold economic benefit, namely, enhancement of the natural gas heating value and production of a marketable gas such as helium. LNG plants also remove the nitrogen from the natural gas because the nitrogen will not remain in the liquid phase during transport of conventional LNG, which is at or near atmospheric pressure.

In general, most known natural gas separation processes comprise at least three distinct operative steps or stages. These include (1) a preliminary gas treatment step for the removal of water and acidic gases such as carbon dioxide and hydrogen sulfide, (2) a natural gas liquids product separation step using low but non-cryogenic temperatures for the separation and recovery of the ethane and heavier hydrocarbon components, and (3) a nitrogen separation or rejection step, often referred to as Nitrogen Rejection Units (NRUs). The nitrogen rejection is generally effected by the cooling of the nitrogen-containing natural gas and fractionating it in a distillation column.

It has recently been proposed to produce methane-rich liquid having a temperature above about −112° C. (−170° F.) And a pressure sufficient for the liquid to be at or below its bubble point. This pressurized liquid natural gas is sometimes referred to as PANG to distinguish it from LNG which is at or near atmospheric pressure. The pressure of PANG will typically be above about 1,380 pa (200 Pisa). One of the advantages of a process for producing PANG is that pressurized liquefied natural gas can contain up to about 10 mole percent nitrogen. However, the nitrogen lowers the heating value of the PANG and increases the bubble point of the PANG product. There is therefore a need for an improved process for removing nitrogen from a natural gas stream and simultaneously producing PANG.

SUMMARY

The invention relates generally to a liquefaction process in which a feed stream containing methane and at least one high-volatility component, such as helium and nitrogen, that has a relative volatility greater than that of methane produces a pressurized liquefied product rich in methane that is substantially free of the higher volatility component. For illustrative purposes, it will be assumed that the more volatile component is nitrogen.

In this inventive process a liquefied, multi-component feed stream is fed to a hydraulic expander means such as one or more hydraulic turbines. The multi-component feed stream is rich in methane and has at least one high volatility component that has a relative volatility greater than that of methane. The feed stream is at or below the feed stream's bubble point and has a temperature above about −112°C. (−170° F.). The expander means reduces the pressure of the feed stream and cools the feed stream, producing gas and liquid phases during pressure reduction. From the expander means the liquid and vapor phases are fed to a separation system to separate the liquid and vapor phases. An overhead vapor stream, enriched in the volatile component, is withdrawn from the separation system. A portion of the overhead vapor stream is preferably withdrawn as a vapor product stream for use as fuel gas or for further processing. The remaining portion of the vapor stream is preferably condensed using either an internal or external refrigeration system. After being condensed, the liquid stream is preferably fed to an upper region of the separation system. A liquid stream rich in methane is recovered from the separation system and pumped to a higher pressure and heated, preferably by indirect heat exchange with the feed stream, to produce a pressurized liquefied product stream having a pressure sufficient for the product stream to be at or below its bubble point and having a temperature above about −112° C. (−170° F.). In the preferred embodiment, the heat exchange between the high-pressure methane-rich stream and the feed stream reduces the refrigeration requirements for the liquefaction process.

BRIEF DESCRIPTION OF THE DRAWINGS

The present invention and its advantages will be better understood by referring to the following detailed description and the attached drawings.

Figure 1:
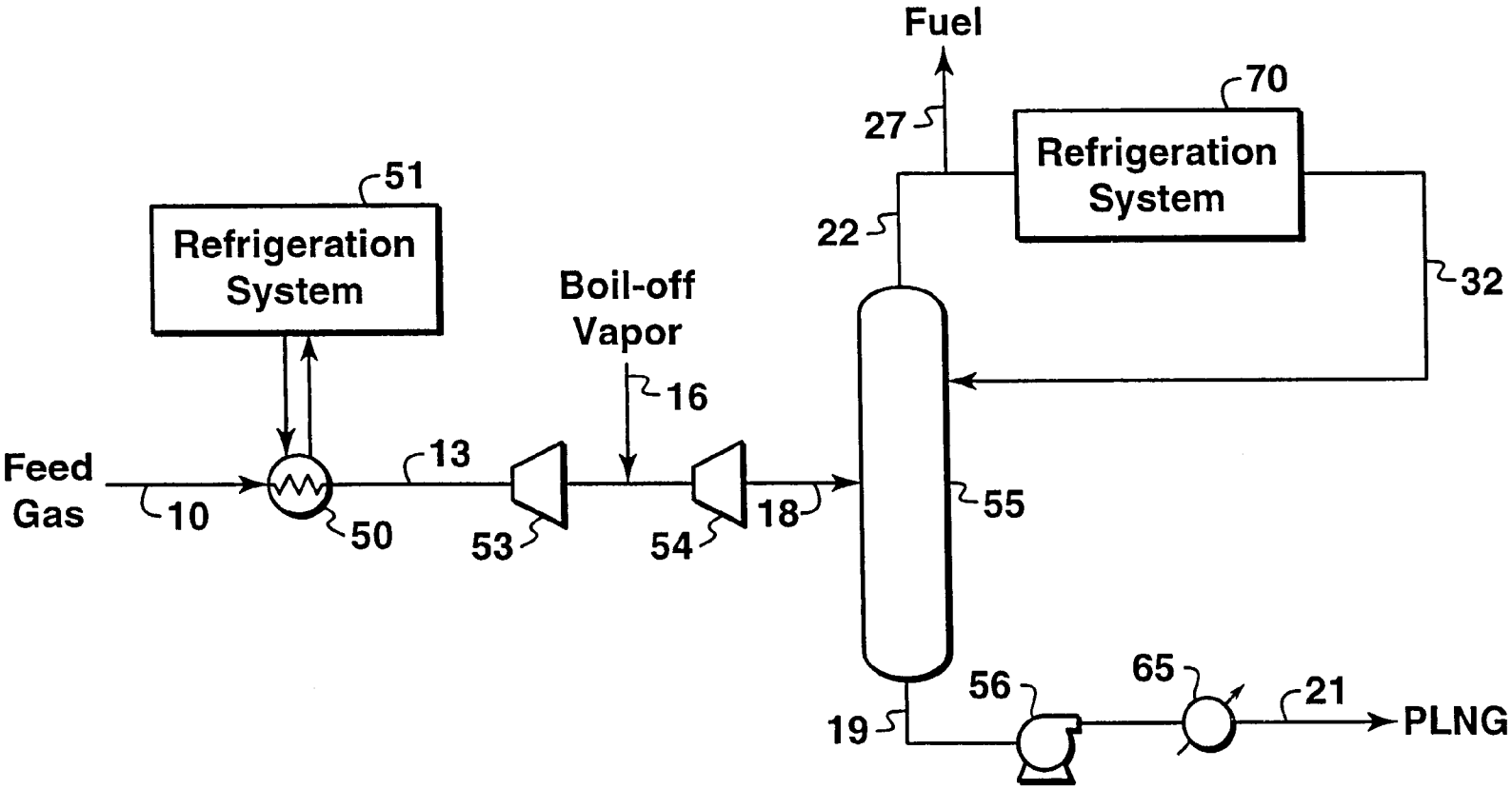
FIG. 1 is a simplified flow diagram of one embodiment of this invention illustrating a cryogenic process for removing nitrogen from a pressurized natural gas and producing PANG.

The flow diagrams illustrated in the drawings present preferred embodiments of practicing the process of this invention. The drawings are not intended to exclude from the scope of the invention other embodiments that are the result of normal and expected modifications of these specific embodiments. Various required subsystems such as valves, flow stream mixers, control systems, and sensors have been deleted from the drawings for the purposes of simplicity and clarity of presentation.

DESCRIPTION OF THE PREFERRED EMBODIMENTS

It has been discovered that a pressurized liquefied natural gas (PANG) can be produced from a conventional nitrogen rejection unit. Indirect heat exchange between the pressured liquefied natural gas stream and other process streams reduce refrigeration requirements of the liquefaction process.

In accordance with this discovery, the present invention provides a process for separation of liquefied natural gas containing methane and at least one high volatility component, such as helium and nitrogen. The separation process produces a liquid natural gas that is substantially free of the high volatility component and that has a temperature above about −112° C. (−170° F.) And a pressure sufficient for the liquid product to be at or below its bubble point. This methane-rich product is sometimes referred to in this description as pressurized liquid natural gas ("PANG").

The term "bubble point" as used in this description is the temperature and pressure at which a liquid begins to vaporize. For example, if a certain volume of PANG is held at constant pressure, but its temperature is increased, the temperature at which bubbles of gas begin to form in the PANG is the bubble point. Similarly, if a certain volume of PANG is held at constant temperature but the pressure is reduced, the pressure at which gas begins to form defines the bubble point. At the bubble point, the liquefied gas is saturated liquid.

The first consideration in cryogenic processing of natural gas is contamination. The raw natural gas feed stock suitable for the process of this invention may comprise natural gas obtained from a crude oil well (associated gas) or from a gas well (non-associated gas). The composition of natural gas can vary significantly. As used herein, a natural gas stream contains methane ($C_1$) as a major component. The natural gas will typically also contain ethane ($C_2$), higher hydrocarbons ($C_{3+}$), and minor amounts of contaminants such as water, carbon dioxide, hydrogen sulfide, nitrogen, butane, hydrocarbons of six or more carbon atoms, dirt, iron sulfide, wax, and crude oil. The solubilities of these contaminants vary with temperature, pressure, and composition. At cryogenic temperatures, $CO_2$, water, or other contaminants can form solids, which can plug flow passages in cryogenic heat exchangers. These potential difficulties can be avoided by removing such contaminants if temperatures equal to or below their pure component, solid temperature-pressure relationship is anticipated. In the following description of the invention, it is assumed that the natural gas stream has been suitably treated to remove sulfides and carbon dioxide and dried to remove water using conventional and well-known processes to produce a "sweet, dry" natural gas stream. If the natural gas stream contains heavy hydrocarbons that could freeze out during liquefaction or if the heavy hydrocarbons are not desired in the PANG, the heavy hydrocarbons may be removed by a fractionation process prior to producing the PANG. At the operating pressures and temperatures of PANG, moderate amounts of nitrogen in the natural gas can be tolerated since the nitrogen will remain in the liquid phase with the PANG. In this description, it is assumed that the natural gas contains nitrogen at levels high enough to justify nitrogen removal in accordance with the separation process of this invention.

The process of this invention will now be described with reference to the flow diagram illustrated in FIG. 1. A natural gas feed stream 10 enters the liquefaction process at a pressure above about 1,380 pa (200 Pisa) and more preferably above about 2,400 pa (350 Pisa) and temperatures preferably above about −112° C. (−170° F.); however, different pressures and temperatures can be used, if desired, and the system can be appropriately modified accordingly. If the gas stream 10 is below about 1,380 pa (200 Pisa), it can be pressurized by a suitable compression means (not shown), which may comprise one or more compressors.

Feed stream 10 is passed through heat exchange zone 50 to liquefy the natural gas. The heat exchange zone 50 may comprise one or more stages cooled by a conventional closed-cycle refrigeration system 51 having propane, propylene, ethane, carbon dioxide, or any other suitable liquid as a refrigerant. This invention is not limited to any type of heat exchanger, but because of economics, plate-fin, spiral wound, and cold box heat exchangers are preferred, which all cool by indirect heat exchange. Refrigeration system 51 is preferably a closed-loop multi-component refrigeration system which is a well known means of cooling by indirect heat exchange to persons having ordinary skill in the art. The term "indirect heat exchange," as used in this description and claims, means the bringing of two fluid streams into heat exchange relation without any physical contact or intermixing of the fluids with each other.

Liquefied natural gas stream 13 exiting heat exchanger zone 50 is then expanded by a suitable expansion means such as conventional hydraulic expanders 53 and 54 to reduce the stream pressure and thereby effect cooling of the stream before the stream enters separation column 55 at an intermediate level. Separation column 55 is a distillation or fractionation column or zone wherein liquid and vapor phases are concurrently contacted to effect separation of a fluid mixture, as for example, by contacting of the vapor and liquid phases on a series of vertically spaced trays or plates mounted within the column or alternatively on packing elements with which the column is filled. Separation column 55 preferably operates at temperatures ranging from about −175° C. (−283° F.) To about −160° C. (−256° F.) And at nearly atmospheric pressures, and more preferably at pressures ranging from about 100 pa to about 120 pa. In separation column 55, vapors enriched with nitrogen and liquid enriched with methane are separated. The liquid leaves separation column 55 as stream 19. Stream 19 is passed to a pump 56 which pumps the liquefied natural gas to the desired storage or transportation pressure. For PANG applications, the pressure will preferably be above about 1,724 pa (250 Pisa). The PANG is preferably passed through heat exchanger 65 to warm the PANG to a temperature above about −112° C. (−170° F.).

Vapor stream 22 exiting the top of nitrogen rejection column 55 contains methane, nitrogen, and other light components such as helium and hydrogen. Typically, the methane-rich vapor stream 22 will contain more than 90% of the nitrogen from the feed and boil-off vapor stream. A first portion of stream 22 is redrawn (stream 27) from the process as fuel or for further processing to recover helium and/or nitrogen. Since stream 22 is at a cryogenic temperature, to use stream 27 as fuel, it will preferably be warmed to a suitable temperature in a heat exchange zone (not shown in the FIG. 1) by the atmosphere, fresh water, or salt water, or warmed by incoming feed stream to the process. A second portion of the overhead vapor stream (stream 32) is passed through a cooling zone 70 to liquefy at least part of stream 32 and is then returned to column 55 as reflux, thereby providing at least part of the refrigeration necessary to operate column 55. The cooling zone 70 can comprise any conventional cooling system that will liquefy at least part of stream 32. For example, the cooling zone can comprise (1) a single, cascade or multi-component closed-loop refrigeration system that cools one or more heat exchange stages, (2) an open-loop refrigeration system using single or multi-stage pressure cycles to pressurize the vapor stream 32 followed by single or multi-stage expansion cycles to reduce the pressure of the compressed stream and thereby reduce its temperature, or (3) indirect heat exchange relationship with a product stream to extract from the product stream the refrigeration contained therein, or (4) a combination of these cooling systems. The optimal cooling system for cooling zone 70 can be determined by those having ordinary skill in the art taking into account the flow rate of stream 22, its composition, and the refrigeration needs of separation column 55.

Figure 2:
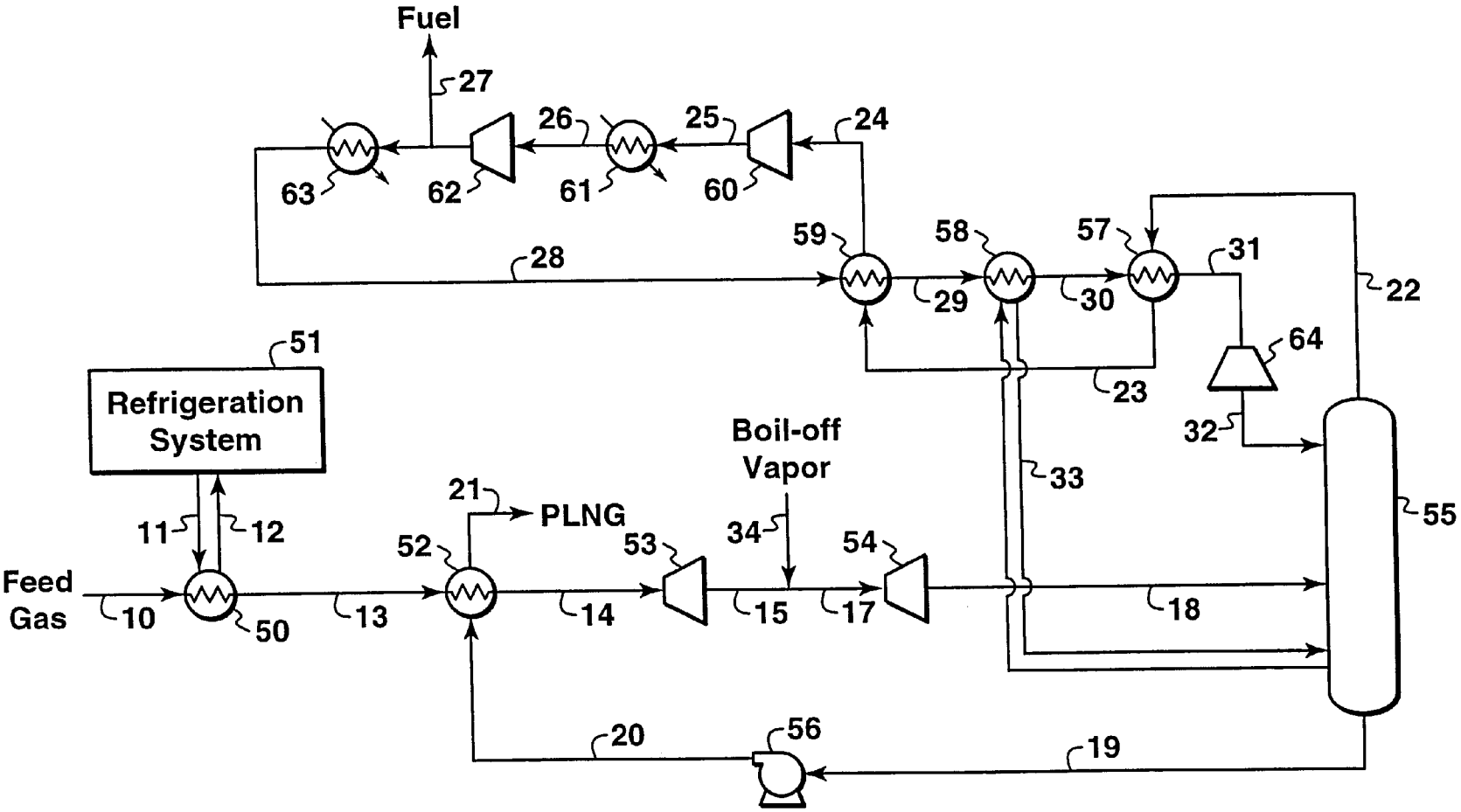
FIG. 2 is a simplified flow diagram of a second embodiment of this invention.

FIG. 2 illustrates a preferred embodiment of process of this invention and in this embodiment the equipment and streams having like numerals to the equipment and streams in FIG. 1 have essentially the same process functions and operate in essentially the same manner. Those persons of ordinary skill in the art will recognize, however, that the process equipment and stream from one embodiment to another may vary in size and capacity to handle different fluid flow rates, temperatures, and compositions.

In the process illustrated in FIG. 2, feed stream 10 is passed through heat exchanger zone 50 to liquefy the natural gas and the cooled stream 13 is further cooled in heated exchanger zone 52, which is cooled by liquid product from fractionation column 55. The cooled liquid stream 14 is then expanded by suitable hydraulic expanders 53, and 54 to reduce the pressure and to further cool the stream. The cold expanded liquefied natural gas is passed to the separation column 55, which produces an overhead vapor stream 22 enriched in nitrogen and a liquid 19 enriched in methane. The liquid is passed to a pump 56 for pressurizing the liquid to a desired storage or transportation pressure. The pressurized liquid is then passed through heat exchanger zone 52 to cool the feed stream in conduit 13 and to warm the pressurized liquid to a temperature above −112° C. (−170° F.), thereby extracting from the product stream the refrigeration contained therein. Indirect heat exchange between the PANG stream and the feed stream in conduit 13 reduces refrigeration power requirements by as much as 40% compared with the power required if the feed stream was not cooled by the PANG. The pressure and temperature of the liquid in conduit 21 is at a temperature above about −112° C. (−170° F.) And a pressure sufficient for the liquid product to be at or below its bubble point.

Vapor stream 22 passes through heat exchangers 57 and 59 to cool the reflux stream being returned to column 55. After exiting heat exchanger 59, the vapor stream is compressed by a single-stage or multi-stage compression train. In FIG. 2, the vapor stream passes successively through two conventional compressors 60 and 62. After each compression step, the vapor stream is cooled by ambient air or water by after-coolers 61 and 63. After the last compression stage, a portion of the vapor stream may be withdrawn and used as fuel gas for gas turbines which drive process compressors and pumps or the withdrawn vapor stream may be further processed to recover commercial quality helium and/or nitrogen. The remaining portion of the vapor stream (stream 28) is passed through heat exchangers 59, 58, and 57 to further cool the vapor stream. Heat exchangers 59 and 57 are cooled by the overhead vapor stream 22 as discussed above. Heat exchanger 58 is cooled by indirect heat exchange with at least one process-derived refrigerant, preferably a bottoms stream (stream 33) withdrawn from the lower portion of the separation column 55. After exiting the heat exchanger 57, the reflux vapor stream (stream 31) is expanded by a suitable expansion device, such as turbo expander 64 to a pressure at or near the operating pressure of separation column 55. The vapor stream is at least partially condensed to a liquid by expander 64. From the expander means the reflux stream (stream 32) enters the upper portion of separation column 55.

In the storage, transportation, and handling of liquefied natural gas, there can be a considerable amount of "boil-off." The process of this invention may optionally re-liquefy such boil-off vapors and also remove nitrogen contained in the boil-off vapors. The primary source of nitrogen impurity in the boil-off vapor is that which is contained in the liquefied natural gas that is the source of the boil-off vapors. Nitrogen, more volatile than liquefied natural gas, flashes off preferentially and concentrates within the boil-off vapor. For example, liquefied natural gas containing 0.3 mole percent $N_2$ can produce a vapor containing approximately 3 mole percent $N_2$. At the higher temperatures and pressure of PANG, the nitrogen flashes off even more preferentially than conventional liquefied natural gas at or near atmospheric pressure.

Referring to FIG. 2, boil-off vapor may be introduced to the process of the invention through stream 34. Although FIG. 1 illustrates introducing the boil-off vapor stream 34 to the process stream at a point between expanders 53 and 54, it will be apparent to those skilled in the art in light of the teachings of this invention, that the boil-off vapor may be introduced at any point in the process before the feed stream is introduced into column 55 and it may also be introduced directly to the column 55. The boil-off vapors introduced to the separation process of this invention should be at or near the pressure of the stream to which the boil-off vapors are introduced. Depending on the pressure of the boil-off vapors, the boil-off vapors may need to be pressure adjusted by a compressor 65 or expanded (not shown in the Figures) to match the pressure at the point the boil-off vapor enters the process.

EXAMPLE

A simulated mass and energy balance was carried out to illustrate the embodiment illustrated in FIG. 2, and the results are set forth in the Table below. The data presented in the Table are offered to provide a better understanding of the embodiment shown in FIG. 2 and are not intended to limit the scope of the invention.

The data were obtained using a commercially available process simulation program called HYSYS™, however, other commercially available process simulation programs can be used to develop the data, including for example HYSIM™, PROII™, and ASPEN PLUS™, which are familiar to those of ordinary skill in the art.

A person skilled in the art, particularly one having the benefit of the teachings of this patent, will recognize many modifications and variations to the specific processes disclosed above. For example, a variety of temperatures and pressures may be used in accordance with the invention, depending on the overall design of the system and the composition of the feed gas. Also, the feed gas cooling train may be supplemented or reconfigured depending on the overall design requirements to achieve optimum and efficient heat exchange requirements. As discussed above, the specifically disclosed embodiments and examples should not be used to limit or restrict the scope of the invention, which is to be determined by the claims below and their equivalents.

TABLE 1

| Stream | Phase Vapor/ Liquid | Pressure psia | Pressure kPa | Temp ° F. | Temp ° C. | Flow lbmole/hr | Flow kgmole/hr | Composition Mole % $C_1$ | $C_2$ | $C_{3+}$ | $CO_2$ | He | $N_2$ |
|---|---|---|---|---|---|---|---|---|---|---|---|---|---|
| 10 | V | 1300 | 8960 | 50 | 10 | 79610 | 36110 | 95.53 | 0.10 | 0.0 | 0.04 | 0.02 | 4.31 |
| 11 | V/L | 390 | 2690 | 55 | 13 | 137520 | 62380 | 29.00 | 48.0 | 23.0 | 0.0 | 0.0 | 0.0 |
| 12 | V | 155 | 1070 | 52 | 11 | 137520 | 62380 | 29.00 | 48.0 | 23.0 | 0.0 | 0.0 | 0.0 |
| 13 | L | 1250 | 8620 | −120 | −84 | 79610 | 36110 | 95.53 | 0.10 | 0.0 | 0.04 | 0.02 | 4.31 |
| 14 | L | 1240 | 8550 | −242 | −152 | 79610 | 36110 | 95.53 | 0.10 | 0.0 | 0.04 | 0.02 | 4.31 |
| 15 | L | 445 | 3070 | −244 | −153 | 79610 | 36110 | 95.53 | 0.10 | 0.0 | 0.04 | 0.02 | 4.31 |
| 17 | L | 445 | 3070 | −223 | −142 | 86200 | 39100 | 95.72 | 0.09 | 0.0 | 0.04 | 0.02 | 4.13 |
| 18 | V/L | 16 | 110 | −262 | −164 | 86200 | 39100 | 95.72 | 0.09 | 0.0 | 0.04 | 0.02 | 4.13 |
| 19 | L | 16 | 110 | −260 | −162 | 79330 | 35990 | 99.36 | 0.10 | 0.0 | 0.04 | 0.00 | 0.50 |
| 20 | L | 475 | 3280 | −256 | −160 | 79330 | 35990 | 99.36 | 0.10 | 0.0 | 0.04 | 0.00 | 0.50 |
| 21 | L | 465 | 3210 | −140 | −96 | 79330 | 35990 | 99.36 | 0.10 | 0.0 | 0.04 | 0.00 | 0.50 |
| 22 | V | 16 | 110 | −270 | −168 | 33120 | 15020 | 53.66 | 0.00 | 0.0 | 0.00 | 0.23 | 46.11 |
| 23 | V | 16 | 110 | −150 | −101 | 33120 | 15020 | 53.66 | 0.00 | 0.0 | 0.0 | 0.23 | 46.11 |
| 24 | V | 16 | 110 | 58 | 14 | 33120 | 15020 | 53.66 | 0.00 | 0.0 | 0.0 | 0.23 | 46.11 |
| 25 | V | 65 | 450 | 344 | 173 | 33120 | 15020 | 53.66 | 0.00 | 0.0 | 0.0 | 0.23 | 46.11 |
| 26 | V | 60 | 410 | 55 | 13 | 33120 | 15020 | 53.66 | 0.00 | 0.0 | 0.0 | 0.23 | 46.11 |
| 27 | V | 410 | 2830 | 453 | 234 | 6860 | 3110 | 53.66 | 0.00 | 0.0 | 0.0 | 0.23 | 46.11 |
| 28 | V | 400 | 2760 | 136 | 58 | 26260 | 11910 | 53.66 | 0.00 | 0.0 | 0.0 | 0.23 | 46.11 |
| 29 | V | 390 | 2690 | −101 | −74 | 26260 | 11910 | 53.66 | 0.00 | 0.0 | 0.0 | 0.23 | 46.11 |
| 30 | V | 380 | 2620 | −140 | −96 | 26260 | 11910 | 53.66 | 0.00 | 0.0 | 0.0 | 0.23 | 46.11 |
| 31 | V/L | 370 | 2550 | −191 | −124 | 26260 | 11910 | 53.66 | 0.00 | 0.0 | 0.0 | 0.23 | 46.11 |
| 32 | V/L | 16 | 110 | −277 | −172 | 26260 | 11910 | 53.66 | 0.00 | 0.0 | 0.0 | 0.23 | 46.11 |
| 33 | L | 16 | 110 | −261 | −163 | 81640 | 37030 | 99.06 | 0.10 | 0.0 | 0.04 | 0.00 | 0.80 |
| 34 | V | 445 | 3070 | −130 | −90 | 6590 | 2990 | 98.00 | 0.00 | 0.0 | 0.0 | 0.0 | 2.0 |

| Power | | Power, kW | Power, hp |
|---|---|---|---|
| Refrigeration | | | |
| System 51 | | 45,040 | 60,410 |
| Compressors | | | |
| 60 | | 22,780 | 30,550 |
| 62 | | 32,460 | 43,530 |
| Pump | | | |
| 56 | | 1,600 | 2,140 |
| | Subtotal | 101,880 | 136,630 |
| Expanders | | | |
| 53 | | −1,410 | −1,890 |
| 54 | | −1,880 | −2,520 |
| 64 | | −4,680 | 6,280 |
| | Subtotal | −7,970 | −10,690 |
| | Total | 93,910 | 125,940 |

What is claimed is:

1. A process for the rejection of a component more volatile than methane from a pressurized liquid natural gas stream containing the volatile component, comprising the steps of:

(a) expanding the liquid natural gas stream to a lower pressure;

(b) passing said expanded gas stream to a fractionation system to produce a liquid stream lean in the volatile component and a vapor stream enriched in the volatile component; and (c) pressurizing the liquid stream to a pressure above about 1,380 kPa (250 psia) and warming the liquid stream to a temperature above about −112° C. such that the pressure and temperature of the liquid stream will be at or below its bubble point.

2. The process of claim 1 further comprises the additional steps of withdrawing a portion of the vapor stream from the fractionation system, cooling the withdrawn portion of the vapor stream to at least partially condense such withdrawn portion and returning to the fractionation system at least part of the cooled, withdrawn portion of the vapor stream as reflux, thereby providing refrigeration duty to the fractionation system.

3. The process of claim 1 wherein the liquid natural gas prior to its expansion in step (a) has a temperature above about −112° C. and pressure such that the liquid natural gas is at or below its bubble point.

4. The process of claim 1 wherein the volatile component is nitrogen.

5. The process of claim 1 wherein the fractionation system has an operating pressure that is nearly atmospheric.

6. The process of claim 1 wherein the volatile component is helium.

7. The process of claim 1 wherein prior to passing the expanded gas stream to the fractionation system, introducing to the expanded gas stream a boil-off gas resulting from evaporation of a liquefied gas.

8. The process of claim 1 wherein at least part of the warming of the liquid stream of step (c) is effected by indirect heat exchange with the liquid natural gas prior to the expansion of step (a).

9. The process of claim 1 wherein the pressurized liquid natural gas prior to its expansion in step (a) is above about 1,380 kPa (200 psia).

10. The process of claim 9 wherein the pressure of the liquid natural gas is above 2,400 kPa (350 psia).

11. A process for the rejection of nitrogen from a pressurized natural gas stream containing nitrogen, comprising the steps of:

(a) cooling the pressurized natural gas stream to produce a first liquid having a temperature above about −112° C. and a pressure sufficient for the first liquid to be at or below its bubble point;

(b) expanding the first liquid to a lower pressure, thereby producing a two-phase gas stream;

(c) passing said two-phase gas stream to a fractionation system to produce a second liquid lean in nitrogen and a vapor enriched in nitrogen;

(d) withdrawing from the fractionation system a first portion of the nitrogen-enriched vapor as a product stream;

(e) cooling a second portion of the nitrogen-enriched vapor whereby said second portion is at least partially condensed;

(f) returning said cooled, at least partially condensed, second portion to the fractionation system as reflux, thereby providing refrigeration duty to the fractionation system;

(g) withdrawing the second liquid from the fractionation system; and (h) pressurizing the second liquid to a pressure above about 1,724 kPa (250 psia) and warming the second liquid to a temperature above about −112° C. such that the pressure and temperature of the second liquid will be at or below its bubble point.

12. A separation process comprising the steps of:

(a) feeding a pressurized liquefied multi-component feed stream to a hydraulic expander means to reduce the pressure of the feed stream and to cool the feed stream, the feed stream containing at least methane and at least one high volatility component having a relative volatility greater than that of methane, said expander forming gas and liquid phases during pressure reduction;

(b) feeding the liquid and vapor phases generated by the expander means to a separation system to produce a liquid fraction lean in the high volatility component and a vapor fraction enriched in the high volatility component;

(c) withdrawing the vapor fraction from the upper region of the separation system;

(d) compressing said vapor fraction to a higher pressure stream;

(e) withdrawing a first portion of the compressed vapor fraction as a compressed vapor stream enriched in the high volatility component;

(f) cooling a second portion of the compressed vapor stream using the cooling available in the vapor fraction of step (c);

(g) expanding the cooled, compressed vapor stream of step (f) to further cool said compressed stream and to at least partially condense the vapor stream;

(h) feeding said expanded stream of step (g) to an upper region of the separation system;

(i) recovering the liquid stream 1can in the high-volatility component from the lower region of the separation system; and (j) pressurizing the liquid fraction and warming the liquid fraction to produce a liquid product having a pressure sufficient for the liquid product to be at or below its bubble point and having a temperature above about −112° C.

* * * * *